US005659987A

United States Patent [19]

Scheggetman

[11] Patent Number: 5,659,987

[45] Date of Patent: Aug. 26, 1997

[54] MULTI-PORTION LABEL AND LABELLING SYSTEM

[75] Inventor: Wim Scheggetman, Fyshwick Act, Australia

[73] Assignee: Diskdeed Printing Technologies Pty. Ltd., Fyshwick, Australia

[21] Appl. No.: 494,729

[22] Filed: Jun. 26, 1995

[30] Foreign Application Priority Data

May 4, 1995 [AU] Australia ..... PN2810

[51] Int. Cl.[6] ..... G09F 3/10

[52] U.S. Cl. ..... 40/299; 283/103; 283/106

[58] Field of Search ..... 283/101, 103, 283/105, 106, 81; 40/299, 771, 638, 630

[56] References Cited

U.S. PATENT DOCUMENTS

| | | | |
|---|---|---|---|
| 1,956,392 | 4/1934 | Leth | 40/771 |
| 1,987,377 | 1/1935 | Stiles | 40/771 |
| 2,176,292 | 10/1939 | Brown et al. | 40/771 |
| 2,193,296 | 3/1940 | Pienzak | 40/771 X |
| 3,822,492 | 7/1974 | Crawley | 283/101 X |
| 4,028,824 | 6/1977 | Miller | 283/101 X |
| 4,159,586 | 7/1979 | Blum | 283/101 X |
| 4,306,367 | 12/1981 | Otto | 283/103 X |
| 4,534,582 | 8/1985 | Howard | 283/103 X |
| 4,592,572 | 6/1986 | Instance . | |
| 4,708,368 | 11/1987 | Instance . | |
| 4,826,211 | 5/1989 | Sinnott et al. | 40/299 X |
| 4,850,612 | 7/1989 | Instance . | |
| 4,850,613 | 7/1989 | Instance . | |
| 4,927,179 | 5/1990 | Ehret et al. . | |
| 5,031,939 | 7/1991 | Webendorfer et al. . | |
| 5,071,167 | 12/1991 | O'Brien . | |
| 5,234,735 | 8/1993 | Baker et al. | 283/101 X |
| 5,263,743 | 11/1993 | Jones | 283/105 X |

FOREIGN PATENT DOCUMENTS

| | | |
|---|---|---|
| 2154540 | 9/1985 | United Kingdom . |
| 2179021 | 2/1987 | United Kingdom . |
| 2190351 | 11/1987 | United Kingdom . |
| 2247661 | 3/1992 | United Kingdom . |
| 2264097 | 8/1993 | United Kingdom . |

*Primary Examiner*—Joanne Silbermann

*Attorney, Agent, or Firm*—Michael D. Bednarek; Kilpatrick & Cody

[57] ABSTRACT

A multi-portion label is provided which avoids the need for carbon paper type duplication. The label can therefore be printed on a single sheet of label material, using a laser printer or the like, instead of relying on impact printers or hand printing. The label includes a main portion which is fixed into place on a package surface or the like. The first portion is contiguous with a second portion which is characteristically folded under the first portion when the label is fixed in place. The first and second portions are, for example, manually separable, whereby the second portion can be withdrawn from underneath the first portion, and can serve as a proof of delivery receipt, or the like.

13 Claims, 3 Drawing Sheets

MULTI-PORTION LABEL AND LABELLING SYSTEM

This invention relates to a multi-portion label and to a labelling system.

This invention has particular but not exclusive application to the transfer of goods, documents or other articles via delivery services. Labels presently used by such delivery services are known as consignment notes.

Consignment notes which are presently in use consist of a plurality of leaves (portions) which are joined and detachable from a common spine. These consignment notes are specifically designed for use with an impact printer, or may be hand written, and are useful where a receipt is required by, for example, the delivery company and the sender. In use, the uppermost sheet is printed by hand or with an impact printer and the underlying sheets received a carbon imprint.

This invention in one aspect resides broadly in a multi-portion label comprising:

a first portion adapted to be fixed to a substrate; and a second portion separable from the first portion, wherein the second portion is at least partially disposed intermediate the first portion and the substrate when the first portion is fixed to the substrate.

Preferably, the first portion at least partially acts as an envelope for the second portion when the first portion is fixed to the substrate.

Preferably the first portion includes fixing means for fixing the first portion to the substrate.

To facilitate printing of the multi-portion label it is preferred that the first and second portions are constituted by a single sheet of printable material. Thus the first and second portions can be printed by a single pass through a conventional printer without the necessity of any carbon imprints.

While the second portion may be disposed intermediate the substrate and the first portion in any suitable manner, in a preferred embodiment the first and second portions are adapted to be folded together such that the first and second portions mutually overlap. In this preferred embodiment the overlapping portion of the first portion includes the fixing means, and the overlapping portion of the second portion constitutes a tab for assisting manual separation of the second portion from the first portion. Preferably, the second portion includes a fold line to facilitate folding.

The first and second portions may be separable via any suitable means. However, it is preferred that a frangible means is disposed intermediate the first and second portions. The frangible means may include, for example, adhesive or tape or other form of connection between the first and second portions. However, it is prefered that the frangible means is a line of perforations.

Similarly, the fixing means may include any suitable means which fixes the first portion to the substrate. For example, the fixing means may include "double-sided" tape, or indeed the first portion may be fixed to the substrate by mechanical means such as staples. In a preferred embodiment the fixing means is adhesive.

The multi-portion label may be of any suitable shape or configuration and adhesive may be located thereon at any suitable points. Most preferably however, the first portion is generally rectangular and, in use, is fixed to the substrate along three sides thereof and the second portion protrudes from beneath the fourth side. The first portion may, of course, be fixed to the substrate by two or even one side.

The second portion may be foldable upon itself to form sub-portions. These sub-portions may also be separable from each other by, for example, frangible means such as a line of perforations. In an arrangement where the second portion consists of two sub-portions, there would be three copies of the printed information, ie. the first portion and the two sub-portions of the second portion.

In one alternative embodiment the multi-portion label includes a third portion separable from the first portion by frangible means. Once again it is preferred that the first, second and third portions are constituted by a single sheet of printable material.

The multi-portion label according to the invention also includes an embodiment wherein the second portion is separable from the first portion prior to use, is adapted to be adhered to the first portion prior to use and is removable from the first portion is use.

While the multi-portion label according to the invention may include only printed matter, it preferred that the multi-portion label also includes identification means. The identification means may be a number, code or other indicia, however it is preferred that the identification means is a bar code. Most preferably the bar code is printed on a tab which is removable from the multi-portion label. Most preferably the tabs include adhesive backing.

It is preferred that the material of the multi-portion label includes a protective coating. Most preferably the coating includes a plastic coating.

In another aspect this invention broadly resides in a method of manufacturing a multi-portion label including:

providing frangible means intermediate a first and second portion of a sheet of printable material;

placing adhesive on selected areas of the first portion; and providing a fold line whereby the second portion can be at least partially folded under the first portion such that the second portion does not contact any adhesive located on the first portion.

Preferably, the frangible means includes a line of perforations.

In a further embodiment the invention resides broadly in a method of using a multi-portion label as hereinbefore described, the method including:

printing information on each portion of the multi-portion label;

folding the multi-portion label such that the second portion is at least partially disposed under the first portion; and adhering the first portion to the substrate.

Preferably, the method further includes manually grasping the second portion, separating the second portion from the first portion, and withdrawing the second portion from between the first portion and the substrate.

In order that this invention may be more easily understood and put into practical effect, reference will now be made to the accompanying drawings which illustrate a preferred embodiment of the invention, wherein.

Figure 1:
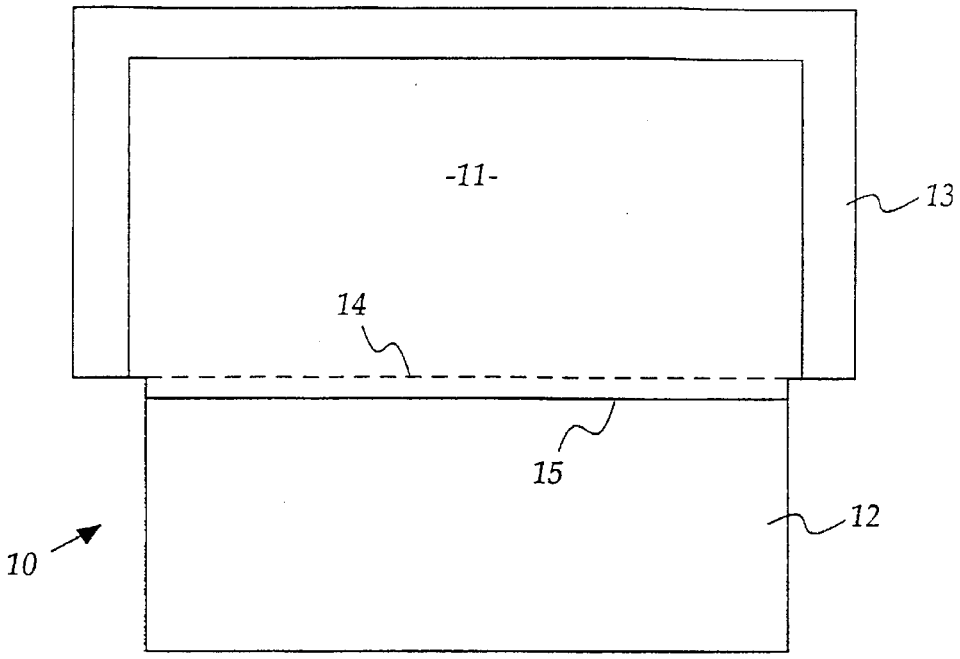
FIG. 1 is rear view of a multi-portion label according to the invention.
Figure 2:
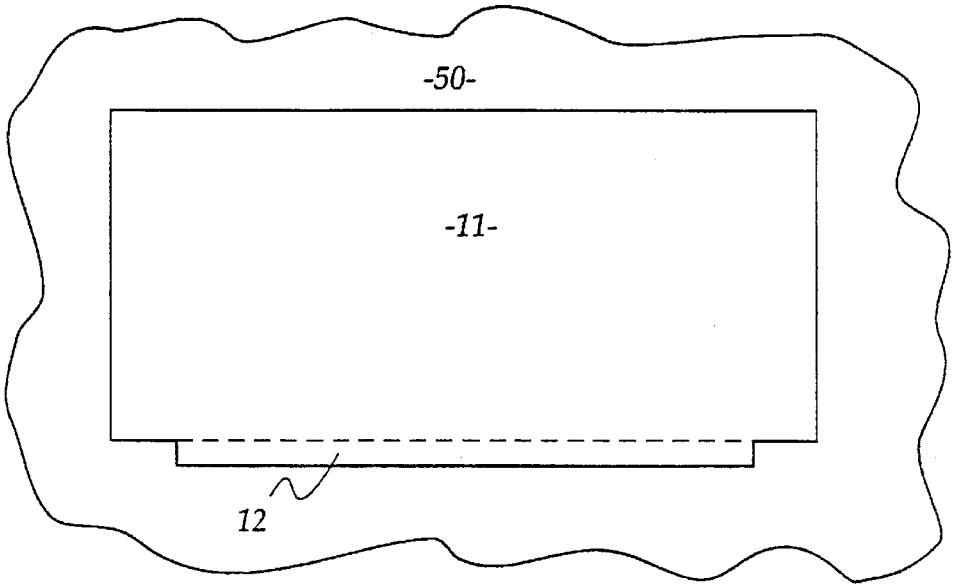
FIG. 2 illustrates a front view of a multi-portion lable of FIG. 1 adhered to a substrate.

Referring to FIGS. 1 and 2, multi-portion label 10 includes first portion 11 and second portion 12. First portion 11 and second portion 12 are defined by a line of perforations 14 which render second portion 12 separable from first portion 11. Second portion 12 includes fold line 15.

First portion 11 includes adhesive 13 on three edges thereof. Adhesive 13 is located and second portion 12 is of a size such that when second portion 12 is folded under first portion 11 about fold line 15 (as seen in FIG. 2), second portion 12 does not contact adhesive 13 but is substantially disposed intermediate first portion 11 and substrate 50. Furthermore, when folded, second portion 12 protrudes from beneath first portion 11 to facilitate manual removal of second portion 12.

The embodiment as illustrated in FIGS. 1 and 2 therefore provides a multi-portion label which may be separated into two copies. Both copies (portions) of the label may be printed by a single pass of the label through a conventional printer without requiring carbon.

Figure 3:
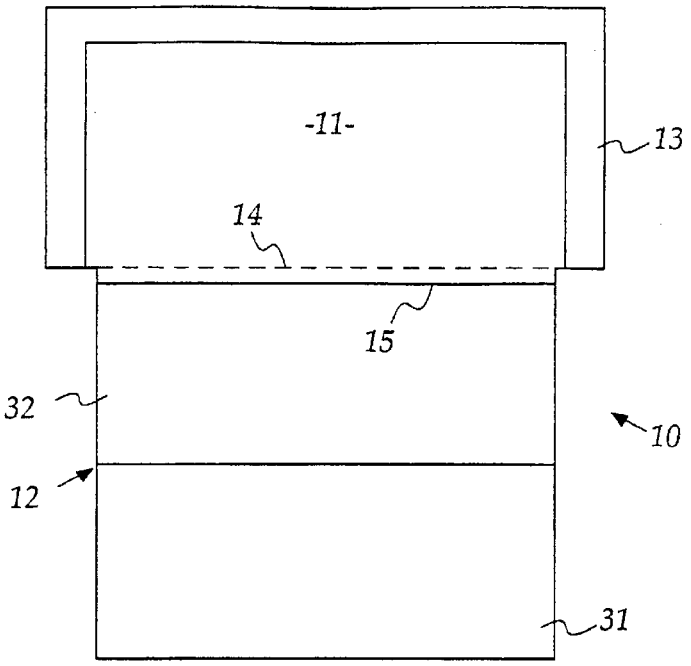
FIG. 3 illustrates an alternative embodiment of the multi-portion label according to the invention.

If a third (or more) copy is required, second portion 12 may be folded upon itself thereby forming sub-portions 31 and 32 (see FIG. 3) which are separable from each other.

Figure 4:
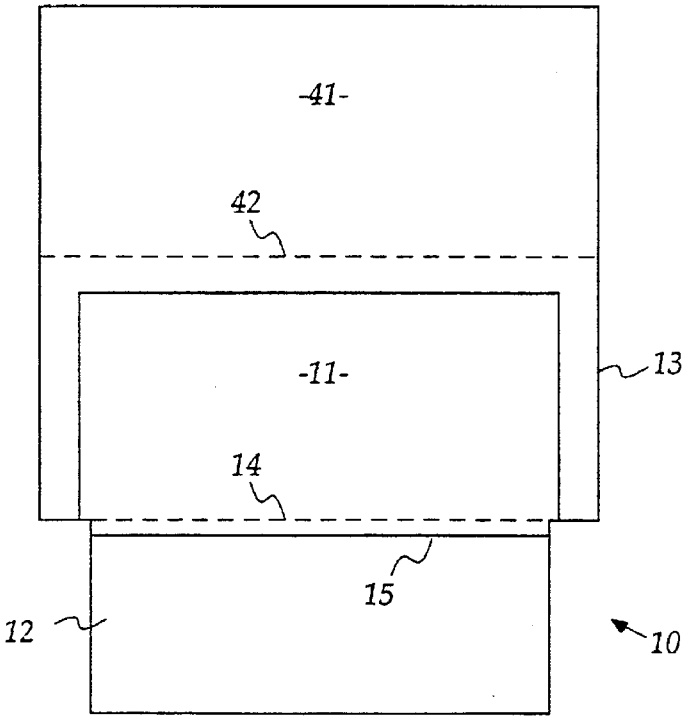
FIG. 4 illustrates a rear view of an alternative embodiment of the multi-portion label according to the invention.

In another embodiment, first portion 11 may be separably connected to third portion 41 by perforations 42 (as seen in FIG. 4). In use, third portion 41 is located adjacent first portion 11 and may be removed before or on delivery of an article. Third portion 41 is not protected by being folded under first portion 11 as is second portion 12.

Figure 5:
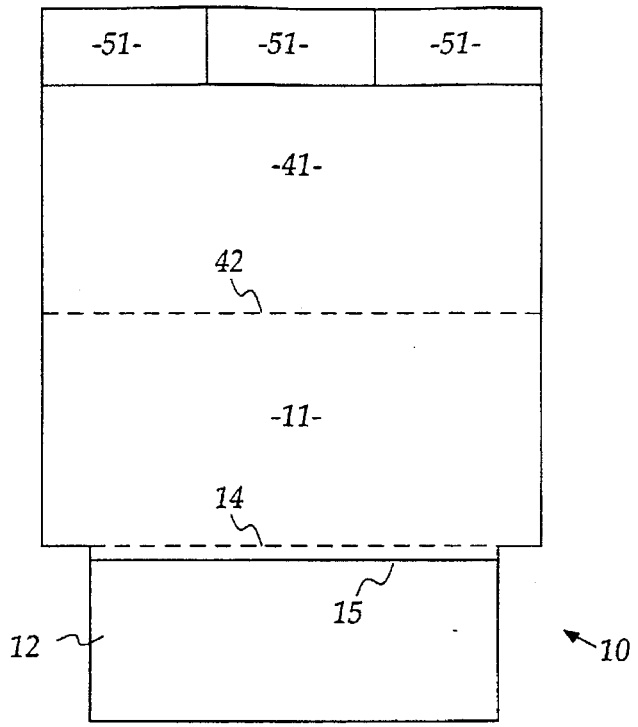
FIG. 5 illustrates a front view of an alternative embodiment of the multi-portion label according to the invention.
Figure 6:
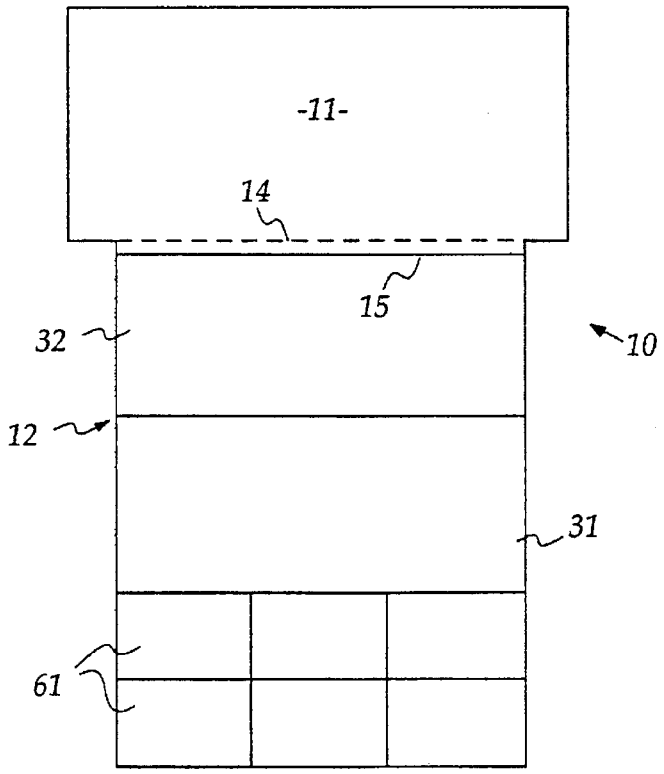
FIG. 6 illustrates front view of an alternative a embodiment of the multi-portion label according to the invention.

As illustrated in FIG. 5, third portion 41 may also include coded tabs 51 which are removable from first portion 41 and include adhesive backing to facilitate adhesion to a substrate. A plurality of coded tabs 61 may also be attached to second portion 12 as seen in FIG. 6.

In use of a multi-portion label according to the invention is passed through a printer, which may be an impact or non-impact printer, and information is printed as required. After printing is completed, the second portion, and any sub-portions thereof, is folded under the first portion. Adhesive which is located on the first portion is then activated or exposed and the multi-portion label is adhered to the relevant article or substrate. It will be understood that the multi-portion label is protected from damage during handling due to its low profile against the substrate.

Upon delivery to the addressee, second portion 12 is manually grasped and separated from first portion 11 which remains fixed to the article. Second portion 12, and any sub-portions thereof, is retained by the delivery service to confirm delivery.

The multi-portion label according to the invention provides many advantages. Firstly, as mentioned above, it may be printed on an impact or non-impact printer without any requirements for carbon paper or the like.

Whilst each portion includes the essential information, the multi-portion label can also be personalised and allocated to a specific client.

As many multiple copies as required can be included in the multi-portion label by including either sub-portions of the second portion or providing additional portions separably attached to the first portion.

Both sides of the multi-portion label can be printed, thus reducing the number of parts required in some instances.

As the multi-portion labels can be printed using a non-impact printer, such as a laser printer, superior legibility and font quality is achieved.

If the multi-portion label includes a bar code or a plurality of bar codes, there is less likelihood of "mismatching" as the multi-portion label and the bar code are generated concurrently.

It is also envisaged that it may also be possible, in the field of postal services, to provide a service and supply system whereby blank multi-portion labels without bar codes are provided to a client at minimal cost and, when printing is required, the client contacts the supplier informing of how many multi-portion labels are required. A number of bar codes corresponding to the required number of multi-portion labels are thereafter down-loaded onto the clients computer via a modem line for a nominal cost per bar code.

The client can then print the multi-portion labels, including the down-loaded bar codes, and send the articles as required.

This system clearly provides a situation wherein account and record keeping are substantially enhanced as when the bar codes are down-loaded by the supplier, computer records are automatically updated.

It will of course be realised that whilst the above has been given by way of an illustrative example of this invention, all such and other modification and variations hereto, as would be apparent to persons skilled in the art, are deemed to fall within the broad scope and ambit of this invention as is herein set forth.

I claim:

1. A multi-portion label including:

a first portion including adhesive means for fixing the first portion to a substrate; and a second portion separable from the first portion by frangible means located therebetween;

wherein the second portion is constructed and arranged to be folded relative to the first portion so as to be at least partially disposed directly intermediate the first portion and the substrate, such that the second portion is removable from underneath the first portion without damage to the first portion, when the first and second portions are separated from one another at the frangible means.

2. A multi-portion label as claimed in claim 1, wherein the second portion is adapted to be folded about a fold line such that it is at least partially disposed intermediate the first portion and the substrate in use, and wherein a portion of the second portion between the frangible means and the fold line is adapted to be manually grasped to facilitate separation of the second portion from the first portion.

3. A multi-portion label as claimed in claim 1, wherein the first portion is generally rectangular and, in use, is fixed to the substrate along three sides thereof and the second portion protrudes from beneath the fourth side.

4. A multi-portion label as claimed in claim 1, wherein, in use, the first and second portions mutually overlap.

5. A multi-portion label as claimed in claim 4, wherein the overlapping portion of the first portion includes the adhesive means for fixing the first portion to the substrate, and the overlapping portion of the second portion constitutes a manually graspable tab to facilitate separation of the second portion from the first portion at the frangible means.

6. A multi-portion label as claimed in claim 1, wherein the second portion includes a plurality of separable sub-portions.

7. A multi-portion label as claimed in claim 1, wherein the multi-portion label further includes a third portion separable from the first portion by second frangible means.

8. A multi-portion label as claimed in claim 7, wherein the first, second and third portions are constituted by a single sheet of printable material.

9. A multi-portion label as claimed in claim 1, wherein the first and second portions are constituted by a single sheet of printable material.

10. A method of manufacturing a multi-portion label including the following steps, in any order:

providing frangible means between a first portion and second portion of a sheet of printable material, whereby the second portion can be separated from the first portion at the frangible means without damaging the first portion;

placing adhesive on a selected area of the first portion for adhesively fixing the first portion to a substrate;

providing a fold line such that the second portion can be folded relative to the first portion so as to be at least partially disposed directly intermediate the first portion and the substrate, such that, when the frangible means is broken, the second portion can be withdrawn from underneath the first portion; and printing generic information on the first and second portions.

11. A method of manufacturing a multi-portion label as claimed in claim 10, wherein the fold line is provided in the second portion such that a portion of the second portion between the frangible means and the fold line is adapted to be manually grasped to facilitate separation of the second portion from the first portion.

12. A method of using a multi-portion label manufactured in accordance with the method of manufacturing a multi-portion label of claim 10, the method of using a multi-portion label including:

printing custom information on the first and second portions of the multi-portion label;

folding the multi-portion label such that the second portion is at least partially disposed under the first portion; and adhering the first portion to a substrate.

13. A method of using a multi-portion label as claimed in claim 12, wherein the method further includes manually grasping the second portion, separating the second portion from the first portion, and withdrawing the second portion from between the first portion and substrate.

* * * * *